United States Patent [19]

Klamm

[11] Patent Number: 4,895,297

[45] Date of Patent: Jan. 23, 1990

[54] BUSINESS FORM SET WITH CLOSABLE ENVELOPE

[75] Inventor: Michael K. Klamm, Belleville, Ill.

[73] Assignee: Moore Business Forms, Inc., Grand Island, N.Y.

[21] Appl. No.: 216,106

[22] Filed: Jul. 7, 1988

[51] Int. Cl.[4] ..... B65D 27/10

[52] U.S. Cl. ..... 229/69; 229/71

[58] Field of Search ..... 229/69, 71, 73

[56] References Cited

U.S. PATENT DOCUMENTS

| | | | |
|---|---|---|---|
| 2,226,574 | 12/1940 | O'Brien | 229/69 |
| 2,983,525 | 5/1961 | Mercur . | |
| 3,117,608 | 1/1964 | Goss et al. . | |
| 3,278,015 | 10/1966 | Bernstein . | |
| 3,428,237 | 2/1969 | Dowen | 229/73 |
| 3,730,355 | 5/1973 | Feldman . | |
| 3,837,565 | 9/1974 | Johnsen . | |
| 3,981,435 | 9/1976 | Johnsen | 229/73 |
| 3,986,613 | 10/1976 | Mayer . | |
| 4,153,163 | 5/1979 | Alderman et al. . | |
| 4,236,731 | 12/1980 | Hektoen . | |
| 4,343,430 | 8/1982 | Martineau . | |
| 4,440,298 | 4/1984 | Knight . | |
| 4,638,940 | 1/1987 | Skokos et al. | 229/73 |
| 4,706,996 | 11/1987 | Fasham | 229/71 |
| 4,744,508 | 5/1988 | Fowler et al. | 229/69 |
| 4,759,494 | 7/1988 | Smyth | 229/70 |
| 4,779,792 | 10/1988 | Lombardo | 229/73 |

FOREIGN PATENT DOCUMENTS

| | | | |
|---|---|---|---|
| 268410 | 5/1988 | European Pat. Off. | 229/73 |
| 2451866 | 7/1960 | France . | |
| 2120364 | 10/1972 | France . | |
| 2306133 | 4/1975 | France . | |
| 2259764 | 12/1975 | France . | |
| 2066209 | 3/1981 | United Kingdom . | |
| 2081215 | 7/1982 | United Kingdom . | |

*Primary Examiner*—Stephen Marcus
*Assistant Examiner*—Jes. F. Pascua
*Attorney, Agent, or Firm*—Nixon & Vanderhye

[57] ABSTRACT

The business form set includes a plurality of rectilinear sheets forming a multi-ply set including first, second, third and fourth sheets. The first first, second and third sheets are joined one to the other at least along a margin and the fourth sheet is formed of plastic material sealed along three of its four margins to corresponding margins on the backside of the third sheet to form an envelope. The fourth margin of the fourth sheet is inset from the corresponding margin of the third sheet whereby the third sheet margin forms a flap. The first and second sheets are carbonless whereby information printed on the first sheet appears on the second and third sheets. A sample vial may be disposed in the envelope and sealed whereby the vial and information on the third sheet remain one with the other.

18 Claims, 2 Drawing Sheets

BUSINESS FORM SET WITH CLOSABLE ENVELOPE

BACKGROUND OF THE INVENTION

The present invention relates to a business form set comprised of multiple business form plies for recording information, two of which plies form a closable envelope for securing a sample, and particularly relates to continuous business form sets useful for recording medical information concerning a patient, a sample from the patient, and laboratory tests for the sample and including an envelope for containing the sample whereby accurate records pertaining to the sample and patient may be consolidated.

There are many instances where information pertaining to an attached sample must be accurately maintained, notwithstanding that the sample is transported between different work locations and handled by different people, all of whom wish to maintain accurate records pertaining to the sample. For example, in a medical setting, it is customary for a laboratory to generate by computer a charge requisition listing various tests which the laboratory can perform. When a physician orders one or more particular tests, the laboratory typically forwards the charge requisition to the physician, together with a container having separate compartments in which samples from the tests, for example, test vials, are placed by the physician after the tests are conducted. One of the compartments is for transmitting the requisition charge from the physician to the laboratory. It will be appreciated that the requisition charge contains vital information concerning the nature of the test, the test date, patient's name, etc. When the container with the requisition is received at the laboratory, the samples, of course, are analyzed and the results forwarded to the physician.

Many problems have arisen using such system. For example, because of the handling of the container, the compartments frequently break down and, if there is leakage from one or more of the vials, the test samples would, of course, become contaminated. Moreover, the test samples may leak into the compartment containing the requisition charge and possibly render the charge unreadable or only readable in part. Additionally, it quite frequently occurs that the physician fails to enclose the requisition charge with the necessary information pertaining to the identity of the patient and the nature of the tests. If that information is omitted, the laboratory cannot correlate the test with a particular patient. This necessitates retesting of that patient. Consequently, there has developed a need for a business form set for containing a sample, for example, a test vial, and wherein information sheets useful to each of the various individuals or organizations involved in handling the sample may be removed from the form set while accurately retaining the necessary and vital information pertaining to the sample as part of the envelope containing the sample.

SUMMARY OF THE PRESENT INVENTION

In accordance with an exemplary embodiment of the present invention, there is provided a business form set comprised of four plies or sheets secured one to the other. Particularly, the first, second and third sheets of the business form set are formed of paper, while the fourth sheet is formed of a plastic material such as polyethylene. Preferably, the three paper sheets are carbonless and are treated in a conventional manner such that information written or printed on the top of the first sheet is reproduced on the second and third sheets. This may be accomplished by using paper coated as described and illustrated in U.S. Pat. No. 4,199,174, of common assignee herewith. The margins of the three sheets of paper are provided with machine feed strips with feed holes spaced therealong. One or more of the sheets have the marginal portions defined by longitudinally extending perforation lines. In this manner, the three paper sheets, together with the fourth sheet as explained hereinafter, may be provided as part of a continuous multi-ply business form having transverse perforations between each multi-ply form set whereby the form sets can be separated one from the other for individual use.

The fourth sheet is preferably formed of a plastic material such as a clear plastic polyethylene. The fourth sheet is secured, for example, by gluing, along three of its four margins to the corresponding marginal portions of the third sheet and along its underside to define an envelope opening adjacent the fourth margin. The free edge of the fourth sheet defining the opening to the envelope is spaced or inset from the machine feed strip adjacent the corresponding margin of the business form set to provide a flap area between the margin and the free edge. This flap area is coated with an adhesive and preferably release paper is provided to overlie the adhesive. Additionally, a perforation line is disposed between and parallel to the adhesive line and the free edge of the fourth sheet.

The first sheet is secured to the second sheet, preferably by mechanical crimps formed along the common margins thereof. The second sheet is glued to the third sheet adjacent one of its margins, i.e., by glueing the machine feed strip of the second sheet to the corresponding machine feed strip of the third sheet, and a perforation line is provided between the second sheet proper and its marginal feed strip. Alternatively, the opposite end of the second sheet may be similarly secured to the third sheet.

In using the continuous business form hereof, information may be written or printed on the three paper sheets by a conventional printer, with the printed or written matter being reproduced on each of the upper surfaces of the second and third sheets, preferably by use of a carbonless system, such as disclosed in U.S. Pat. No. 4,199,174. The individual or organization providing the form set may remove the first sheet from the form set and retain it for record-keeping purposes. For example, if a medical laboratory is providing the form, the continuous form set is run through a printer and each set of forms would be forwarded to a physician upon request, the laboratory retaining the first sheet for its records. After the physician performs the tests, and writes or prints on the second sheet the nature of the tests, the identity of the patient and other pertinent information, the second sheet is removed from the form set and retained by the physician. It will be appreciated that the information provided by the physician on the second sheet has also been reproduced on the third sheet. The physician then places the sample-containing vial in the envelope on the back of the third sheet formed by the third and fourth sheets, removes the release paper from the adhesive and folds the flap over onto the face of the fourth sheet to close the envelope, thereby retaining the sample in the envelope. When the recipient, e.g., a laboratory, receives the envelope with the vial, the necessary identifying information is written or printed on the third sheet, which forms an integral part of the envelope. Consequently, the information necessary to report the test and the test sample are together and have not theretofore been separated one from the other. This obviously ensures that all the information pre-printed on the form set, as well as provided by the physician, remains with the particular sample. Preferably, at least the bottom surface of the third sheet is coated with PVC such as to render the envelope substantially impenetrable by liquids or other materials of the samples.

In a preferred embodiment in accordance with the present invention, there is provided a business form set comprised of a plurality of rectilinear sheets forming a multi-ply set thereof, including first, second, third and fourth sheets, the first, second and third sheets being comprised of paper. Means are provided for releasably securing the first and second sheets one to the other along a common margin thereof, and for releasably securing the second and third sheets one to the other along a common margin thereof. Preferably, the fourth sheet is formed of a plastic material. Additional means are provided for adhering the fourth sheet to the side of the third sheet opposite the first and second sheets and continuously adjacent three of four substantially common margins of the third and fourth sheets to define an envelope on the back side of the form set having an opening located between the free margin of the fourth sheet and the third sheet, the free margin being inset from the corresponding margin of the third sheet to define a flap portion along the corresponding margin of the fourth sheet and foldable to overlie a portion of the fourth sheet to close the opening. Means, e.g., a rewettable adhesive, are carried by the flap portion along the back side of the fourth sheet for securing the flap to the fourth sheet portion.

In a further preferred embodiment in accordance with the present invention, there is provided a continuous business form comprised of a plurality of generally rectilinear business form sets secured along their transverse edges one to the other by perforation lines, each form set comprising a multi-ply set thereof including first, second, third and fourth sheets, the first, second and third sheets of each set being comprised of paper. Means for releasably securing the first and second sheet of each set one to the other along a common margin thereof and for releasably securing the second and third sheet of each set one to the other along a common margin thereof are provided. The fourth sheet of each set is preferably formed of a plastic material. Means are additionally provided in each set for adhering the fourth sheet to the side of the third sheet opposite the first and second sheets and continuously adjacent three of four substantially common margins of the third and fourth sheets to define an envelope on the back side of the form set having an opening located between the free margin of the fourth sheet and third sheets, the free margin of the fourth sheet being inset from the corresponding margin of the third sheet to define a flap portion along the corresponding margin of the third sheet and foldable to overlie a portion of the fourth sheet to close the opening. Means, e.g., a rewettable adhesive strip, are carried by the flap portion along the back side of the third sheet for securing the flap to the fourth sheet portion. The opposite margins of each of the first, second and third sheets of each set of the continuous business form have marginal machine feed strips with feed holes.

Accordingly, it is a primary object of the present invention to provide a novel and improved continuous business form having multiple form sets detachable one from the other and wherein each set has a series of superposed carbonless sheets or plies, certain ones of which are detachable, together with an envelope impenetrable by liquid, whereby information recorded and reproduced on all the sheets is maintained with the article or sample disposed in the envelope.

These and further objects and advantages of the present invention will become more apparent upon reference to the following specification, appended claims and drawings.

BRIEF DESCRIPTION OF THE DRAWING FIGURES

Figure 1:
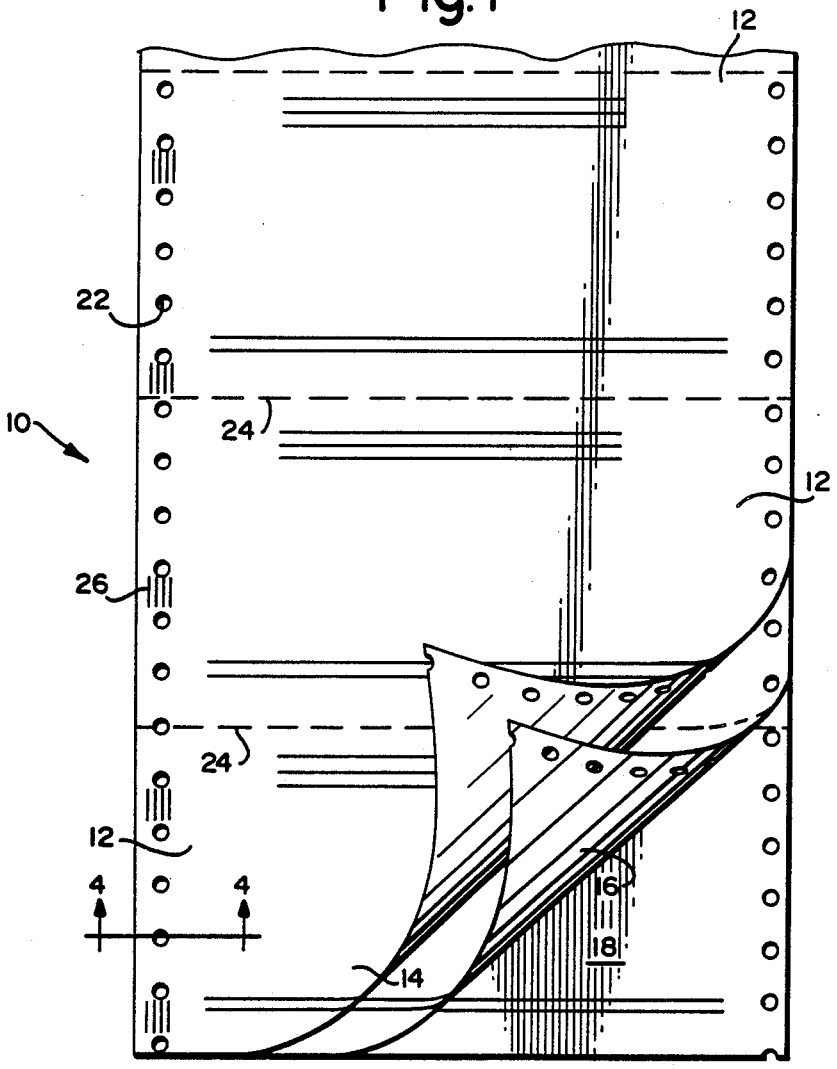
FIG. 1 is a fragmentary plan view of a continuous business form comprised of individual sets of multiple business form plies, with two of the uppermost plies pulled partially away from the underlying plies.
Figure 2:
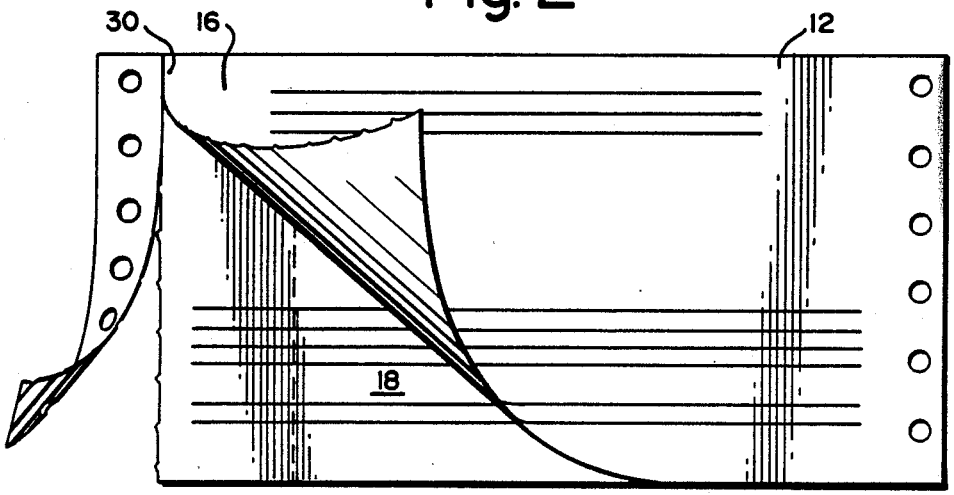
FIG. 2 is a view similar to FIG. 1 illustrating a single multi-ply business form set constructed in accordance with the present invention.
Figure 3:
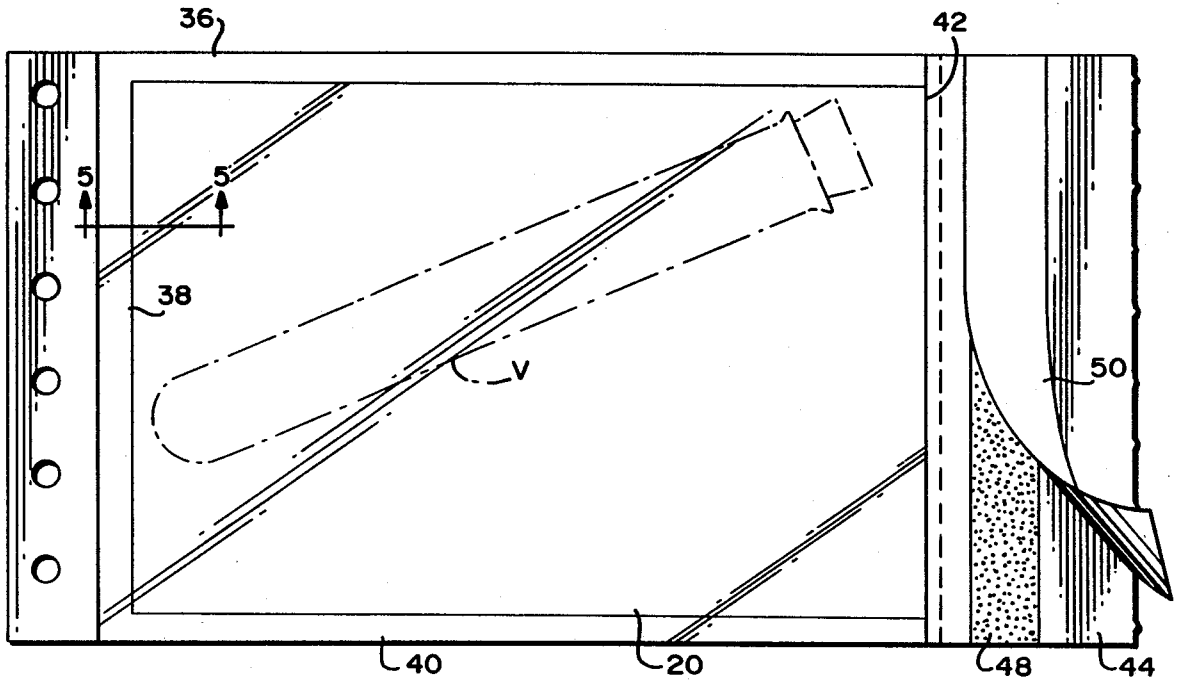
Figure 5:
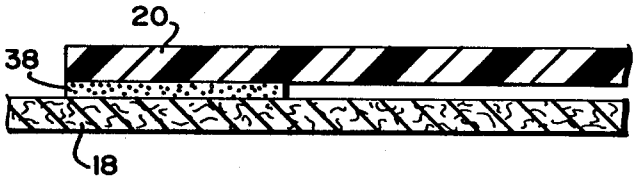
Figure 4:
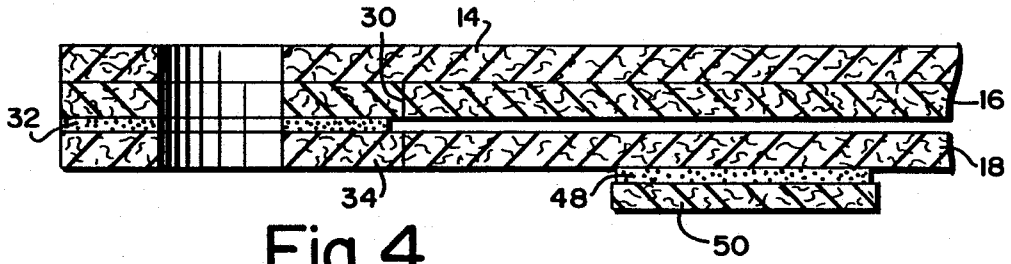

FIG. 3 is an enlarged plan view of the underside of the business form set illustrated in FIG. 2 with portions of a release strip partially removed from the set; and FIGS. 4 and 5 are fragmentary cross-sectional views taken generally about on lines 4—4 and 5—5 in FIGS. 1 and 3, respectively.

DETAILED DESCRIPTION OF THE DRAWING FIGURES

Reference will now be made in detail to the present preferred embodiment of the invention, an example of which is illustrated in the accompanying drawings.

Referring now to FIG. 1, there is illustrated a continuous business form, generally designated 10, comprised of a plurality of business form sets, each being designated 12. Each form set 12 is comprised of multi-plies of sheet material secured one to the other in the manner set forth below and in the preferred form of the invention, comprise first, second and third paper plies 14, 16 and 18, respectively, together with a final and fourth ply 20, preferably formed of a plastic material. As illustrated in FIG. 1, the continuous business form 10 is provided with tractor openings 22 along its lateral margins such that it may be advanced by sprocket wheels typically carried by business machines, such as printers. Preferably, the three paper forms 14, 16 and 18 are carbonless and are thus treated in a conventional manner, for example, as set forth in U.S. Pat. No. 4,199,174, such that the information recorded on the top face of the first sheet is reproduced on the second and third sheets. Additionally, it will be seen that transverse lines of perforations 24 are provided between adjacent business form sets 12 such that each set may be separated from the adjacent sets. The perforations 24 are, of course, provided on each of the four plies of the business set.

Because the first ply or sheet 14 of each set, when the sets are used as previously described, is retained by the laboratory, the margins of the four plies are at least mechanically crimped one to the other at longitudinal spaced positions, preferably along a single margin on one side of the continuous business form, to secure the otherwise unsecured first form 14 to the form set. Thus, as illustrated in FIG. 1, the first ply or sheet 14 of each set 12 is mechanically crimped at 26 along its left margin at longitudinally spaced positions to the remaining three plies.

The second ply or sheet has a micro-encapsulated coating front and back and has a longitudinal line of perforations 30 along its left margin inset from tractor openings 22 as illustrated in FIG. 2. The right margin may similarly have a line of perforations inset from the tractor openings 22 but may also be free.

The third sheet 18 is preferably a PVC-coated micro-encapsulated front sheet which is glued along the left-hand margin to the margin of the overlying second sheet as indicated at 32 in FIG. 4. A line of perforations 34 connect the margin of the third sheet 18 with the marginal tractor strip, also as illustrated in FIG. 4.

Referring now to FIGS. 3 and 5, the fourth ply or sheet 20 is preferably formed of polyethylene. Adhesive is applied continuously adjacent three of the four substantially common margins of the third and fourth sheets as at 36, 38 and 40 such that the third and fourth sheets define an envelope on the backside of the form set having an opening 42 located between the free margin of the fourth sheet and the third sheet. As illustrated in FIG. 3, a portion 44 of the third sheet extends laterally beyond the end edge 42 of the fourth sheet 20 to form a flap for the envelope defined by the third and fourth sheets. A fold line or a line of perforations 46 may be provided in the third sheet adjacent the edge 42 of the fourth sheet such that the flap may be folded to overlie the outer face of the fourth sheet 20 to close the opening. Preferably, a line of adhesive 48 is applied to the underside of the flap 44 and a release tape 50 is applied to overlie and protect the adhesive 48.

In use, the continuous business form is preprinted with the desired information, for example, the nature of the tests to be performed, the laboratory to which the samples are to be forwarded for testing, and information blocks on the second sheet whereby the physician may record the pertinent data with respect to the test and patient identification information. The individual business form set is then removed from the adjoining set and the top sheet 12 is removed by pulling it away from the remaining sheets, breaking the mechanical crimp connections. This may be retained as a record. The second, third and fourth sheets of the business form set are then forwarded to the physician, who completes the information blocks on the second sheet with the recorded information being also recorded on the third sheet through the carbonless paper. The physician may then remove the second sheet 16 by tearing along its perforation line 30, take the sample from the patient and dispose it in a vial, and enclose the sample vial, for example as illustrated at V in FIG. 3, in the envelope. The envelope is then sealed by removing the release tape 50 and folding the flap 44 over the fold or perf line 46 onto the backside of the fourth sheet 20 to close and maintain closed the envelope opening. Consequently, the pertinent identifying information, both patient and test information, is recorded on the third sheet 18 which forms an integral part of the envelope in which the test sample is disposed. In this way, the sample vial V does not become separated from the recorded information.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A business form set comprising:

a plurality of rectilinear sheets forming a multi-ply set thereof and including first, second, third and fourth sheets;

said first, second and third sheets being comprised of paper;

means for releasably securing said first and second sheets one to the other along a common margin thereof;

means for releasably securing said second and third sheets one to the other along a common margin thereof;

said fourth sheet being formed of a plastic material;

means for adhering said fourth sheet to the side of said third sheet opposite said first and second sheets and continuously adjacent three of four substantially common margins of said third and fourth sheets to define an envelope on the back side of said form set having an opening located between a free margin of said fourth sheet and said third sheet, said free margin being inset from the corresponding margin of said third sheet to define a flap portion along said corresponding margin of the third sheet and foldable to overlie a portion of said fourth sheet to close said opening; and means carried by said flap portion along the back side of said third sheet for securing said flap to said fourth sheet portion.

2. A business form set according to claim 1 wherein said adhering means includes glue.

3. A business form set according to claim 1 including means for reproducing written or printed material on said first sheet on the top surfaces of said second and third sheets.

4. A business form set according to claim 3 wherein said reproducing means is carbonless, said first and second sheets having coatings on the bottom and top surfaces thereof, respectively, and said second and third sheets having coatings on the bottom and top surfaces thereof, respectively, for reproducing the written or printed material on the top of said first sheet.

5. A business form set according to claim 1 wherein the side of said third sheet in opposition to said fourth sheet is coated with a plastic material.

6. A business form set according to claim 2 including a line of perforations along said third sheet coincident with and constituting a foldline about which said flap is folded to close said envelope.

7. A business form set according to claim 1 wherein the opposite sides of each of said first, second and third sheets have marginal machine feed strips with feed holes spaced longitudinally therealong.

8. A business form set according to claim 7 wherein the marginal feed strip of said second sheet adjacent the margin thereof secured to said third sheet is defined by a longitudinally extending line of perforations.

9. A business form set according to claim 8 wherein the marginal feed strips of said second and third sheets, secured one to the other by said releasable securing means, are glued one to the other.

10. A continuous business form, comprising:

a plurality of generally rectilinear business form sets secured along their transverse edges one to the other by perforation lines;

each said form set comprising a multi-ply set thereof including first, second, third and fourth sheets;

said first and second sheets of each set being comprised of paper;

means for releasably securing said first and second sheets of each set one to the other along a common margin thereof;

means for releasably securing said second and third sheets of each set one to the other along a common margin thereof;

at least a portion of said third sheet facing said fourth sheet in each set being coated with a plastic material and said fourth sheet being formed of a plastic material;

means in each set for securing said third and fourth sheets one to the other with respective facing portions thereof in opposition one to the other to define an envelope having an opening located between a free margin of said fourth sheet and said third sheet, said free margin being inset from a margin of said third sheet such that said margin of the third sheet defines a flap portion foldable to overlie a portion of said fourth sheet to close the opening;

the plastic materials of said facing portions of said third and fourth sheets, respectively, rendering said envelope impervious to liquids;

means for securing said flap portion and said fourth sheet portion one to the other to maintain said envelope closed; and opposing margins of each of the first, second and third sheets of each set of the continuous business form having marginal machine feed strips with feed holes.

11. A business form set according to claim 10 wherein said third sheet is coated on said facing portion with microencapsulated PVC.

12. A continuous business form according to claim 10 wherein the marginal feed strip of said second sheet of each set thereof adjacent the margin thereof secured to said third sheet is defined by a longitudinally extending line of perforations.

13. A business form set according to claim 10 wherein said securing means in each set includes an adhesive.

14. A business form set according to claim 10 including means in each set for reproducing written or printed information on said first sheet on the top surfaces of said second and third sheets.

15. A business form set according to claim 14 wherein said reproducing means is carbonless, said first and second sheets having coatings on the bottom and top surfaces thereof, respectively, and said second and third sheets having coatings on the bottom and top surfaces thereof, respectively, for reproducing the written or printed information on the top of said first sheet.

16. A business form set according to claim 11 including, in each set, a line of perforations along said third sheet coincident with and constituting a foldline about which said flap portion is folded to close said envelope.

17. A business form set according to claim 10 wherein, in each set, the marginal feed strips of said second and third sheets, secured one to the other by said releasable securing means, are adhesively secured one to the other.

18. A business form set comprising:

a plurality of rectilinear sheets forming a multi-ply set thereof and including first, second, third and fourth sheets;

said first and second sheets being comprised of paper;

means for releasably securing said first and second sheets of each set one to the other along a common margin thereof;

means for releasably securing said second and third sheets of each set one to the other along a common margin thereof;

means in each set for securing said third and fourth sheets one to the other continuously adjacent three of four substantially common margins of said third and fourth sheets to define an envelope having an opening located between a free margin of said fourth sheet and said third sheet, said free margin being inset from the corresponding margin of said third sheet to define a flap portion along said corresponding margin of the third sheet and foldable to overlie a portion of said fourth sheet to close the opening;

means for securing said flap portion and said fourth sheet portion one to the other to maintain said envelope closed; and said securing means including an adhesive, and said reproducing means being carbonless, said first and second sheets having coatings on the bottom and top surface thereof, respectively, and said second and third sheets having coatings on the bottom and top surfaces thereof, respectively, for reproducing the written or printed material on the top surface of said first sheet on the top surfaces of said second and third sheets, the side of said third sheet in opposition to said fourth sheet being coated with a plastic material, said fourth sheet being formed of a plastic material whereby said envelope is impervious to liquids, means defining a line of perforations along said third sheet coincident with and constituting a foldline about which said flap is folded to close said envelope, wherein the opposing margins of each of said first, second and third sheets have marginal machine feed strips with feed holes spaced longitudinally therealong.

* * * * *